United States Patent [19]

Makipirtti

[11] 4,169,725

[45] Oct. 2, 1979

[54] PROCESS FOR THE REFINING OF SULFIDIC COMPLEX AND MIXED ORES OR CONCENTRATES

[75] Inventor: Simo A. I. Makipirtti, Nakkila, Finland

[73] Assignee: Outokumpu Oy, Helsinki, Finland

[21] Appl. No.: 900,768

[22] Filed: Apr. 27, 1978

Related U.S. Application Data

[63] Continuation of Ser. No. 682,157, Apr. 30, 1976, abandoned.

[51] Int. Cl.[2] ..... C22B 15/00

[52] U.S. Cl. ..... 75/74; 75/21; 75/23

[58] Field of Search ..... 75/21, 23, 26, 72, 74, 75/63

[56] References Cited

U.S. PATENT DOCUMENTS

| | | | |
|---|---|---|---|
| 1,762,867 | 6/1930 | Johannsen | 75/21 |
| 3,459,535 | 8/1969 | Vizsolyi et al. | 75/21 |
| 3,790,366 | 2/1974 | Bryk et al. | 75/74 |
| 3,892,560 | 7/1975 | Nermes et al. | 75/74 |
| 3,948,639 | 4/1976 | Nermes et al. | 75/74 |

*Primary Examiner*—M. J. Andrews

*Attorney, Agent, or Firm*—Brooks, Haidt, Haffner & Delahunty

[57] ABSTRACT

A suspension of finely divided impure sulfidic complex or mixed ores or concentrates and air flowing downwards in a reaction zone at a high temperature is first oxidized to vaporize the impurities and then reduced or sulfidized to bring the unvaporized impurities into the gas phase before separating thesolids from the gas phase.

7 Claims, 7 Drawing Figures

PROCESS FOR THE REFINING OF SULFIDIC COMPLEX AND MIXED ORES OR CONCENTRATES

This is a continuation, of application Ser. No. 682,157, filed Apr. 30, 1976, now abandoned.

BACKGROUND OF THE INVENTION

The present invention relates to a process for the suspension smelting of sulfidic and mixed ord or concentrates in order to separate the impurity minerals or metals present in them.

The process according to the invention thus relates to improving the refinability of sulfidic complex and mixed ores or concentrates. These ores and concentrates usually contain copper, nickel, cobalt, and iron as their principal components. Owing to the manner in which the ores were formed they also contain, in addition to the principal components, elements which are to be considered impurities in regard to them, either quantitatively or qualitatively, but are often rare and therefore valuable. The impurities are heavy and often easily vaporizable elements, usually with a high number in the periodic system, such as Zn, Cd, Hg, Ga, In, Tl, Ge, Sn, Pb, As, Sb, Bi, Mo, W, Re. The said elements usually form very stable polymorphous complex compounds with arsenic, antimony and bismuth plus the principal metal, or between themselves.

Some of these elements—e.g., As, Sb, Bi, Pb, Zn, Sn—cause very great problems in the metallurgy of copper and nickel. In conventional pyrometallurgical refining processes these components, being easily dissociated into metals from their compounds, accompany the principal metal through the various stages of the process. Although some of these components are removed from the system at each stage of the refining process, some of them remain in the crude metal and even in very low concentrations entirely prevent or greatly complicate its further refining.

The invention thus relates to a process for removing the impurity minerals or metals present in sulfidic complex and mixed ores and concentrates by the suspension smelting technique. According to the process, some of the elements which are present in complex ores and greatly disturb their metallurgical treatment can be removed entirely or to a considerable degree from the sulfide matte and slag phases created as molten products.

The metals covered by the process which are to be considered impurities in regard to the principal metals (copper and/or nickel) but are often very rare and therefore valuable include the heavy elements usually with a high number in the periodic system, such as (group-period-metal): II-4,5,6-Zn, Cd, Hg; III-4,5,6-Ga, In, Tl; IV-4,5,6-Ge, Sn, Pb; V-4,5,6As, Sb, Bi; VI-5-Mo; VII-6-Re.

Several of these components form highly complex mineral structures with the principal metals or between themselves. For the implementation of the process under discussion it is advantageous, especially if the concentrations of the impurity metals are high, to rearrange the complex minerals into simple or independent sulfide minerals before processing.

To illustrate the present-day technological level of the suspension and suspension vaporization processes, the development of suspension processes is discussed here generally and some examples are given of the numerous suspension vaporization processes. The known processes comparable with that according to the invention are mainly vertical suspension processes in which either conventional reaction shaft smelting or cyclone smelting is used.

The first large-scale technological application of vertical suspension smelting is the process according to U.S. Pat. No. 2,506,557, developed mainly for the refining of sulfidic copper concentrates. The application of the same process to pyrite concentrates for the production of elemental sulfur is described in U.S. Pat. No. 3,306,708 and, in a more developed form, in Canadian Pat. No. 844,504. The reduction of the sulfur dioxide present in the smelting plant gases by means of solid carbon by the suspension process has been solved in the process according to Canadian Pat. No. 867,269. The reduction of the slag phase with a valuable metal content obtained in the production of rich copper matte, the sulfidization of the flying dusts, and the reduction of the smelting plant gases to the desired quantity in vertical suspension smelting are the essence of the process according to Canadian Pat. No. 909,517. The suspension smelting of iron-poor nickel sulfide matte by zone reduction for the selective sulfidization of nickel and for the system for lowering the ferric iron is performed by the process according to U.S. Pat. No. 3,754,891. Finally, in the development of vertical suspension smelting we should mention the processing of very finely-divided oxidic and sulfidic ores and concentrates according to Finnish Pat. No. 48,202 and the manufacture of crude copper and converter matte by the process according to Finnish Patent Application 1992/74.

In connection with the said vertical suspension smelting processes, impurity components pass both mechanically and chemically into the gas and flying dust phases. Owing to the methods, equipment technology, and other factors, the quantities which are transferred are, however, very low when using conventional processes.

The use of vertical suspension smelting for vaporizing impurities or the principal metal is undoubtedly best known in the processes developed by Prof. Alfred Lange. In Lange's process (e.g., GDR Pat. 18, 783 and GFR Pat. 1,052,692) concentrates, flying dusts, industrial intermediate products, etc. with high zinc and lead concentrations are strongly oxidized in suspension at a high temperature (1000°–1600° C.) in the upper part of a vertical reaction shaft. The upper part of the reaction shaft, having a considerably greater diameter than the lower part, comprises a cyclone-resembling part which is either spherical or elongated into a cylinder with spherical ends; the concentrate-air suspension in a strong turbulent motion produced by tangential blowing in the concentrate disperser is fed into this part. Additional air and fuel are fed tangentially into the cylindrical or spherical part. Thereby the vaporizable components of the concentrate are caused to pass into the gas phase, and the non-vaporizable sulfidic and other components, under the effect of centrifugal forces, impinge against the cylinder walls, from where they flow through the narrower shaft part into the matte and slag collecting tank in the lower furnace. Under the reaction shaft, secondary air is fed into the furnace in order to burn the still unburned compounds in the shaft product and the fuel, and the heat amount thereby obtained is used for covering the heats of reaction and thermal losses in the lower furnace. According to the process, the increased delay period necessary for the vaporization and the control of the settling period of the molten and solid materials are obtained by means of the turbulences in the upper part of the reaction shaft and by means of additional air and other gases. The secondary air can be used not only for the above control but also for controlling the concentration in the copper matte in the collection tank.

The lower-furnace floor in Lange's furnace system rises from the horizontal level (towards the rising shaft). Before the rising shaft or under it there can be, sunk in the furnace floor, a "pocket" for the recovery of mechanical dusts. This dust chamber can also be located after the rising shaft. The construction of the furnace system has a decisive role in the process. These furnace constructions have been described not only in the patent but also in, for example, the following publications: A. Lange: Metallurgie u. Giessereitechnik, 4, H12, 1954, 538–547; A. Lange, J. Barthel: Bergakademie 9, 1961, 554–563.

The concentrates and byproducts of the Lange vaporization process, as well as the vaporizable compounds and metals (e.g., Zn, Pb, Sn, Cd, Ge, Re), are mentioned, in addition to the said publications, in, for example: J. Barthel: Freib. Forsch H, B 112, 1965, 13–36; Leipner: Neue Hutte, 16, H 7, 1971, 395–399.

What is most noteworthy is the very high impurity contents in the matte and slag phases obtained in Lange's vaporization process. The following analysis values (Me, % by weight) are given as an example (GDR Pat. 18 783):

Feed 1./2. 41.8/22.0 Zn; 0.96/16.0 Pb; 0.5/0.5 Cu
Matte 1./2. 5.9/7.6 Zn; 0.10/9.5 Pb; 56.6/7.2 Cu
Slag 1./2. 6.77/3.24 Zn; 0.06/0.20 Pb; -/0.12 Cu
Dust 1./2. 60.8/47.9 Zn; 2.7/18.7 Pb; -

Another example of the separation of lead and zinc from molten products by the vertical suspension process is the process according to Rumanian Pat. 54 991. The process includes the conventional vertical suspension smelting process and a feed burning apparatus. It should be noted that the process actually comprises nothing novel in comparison with the known vertical suspension processes. The described concentrate burner hardly produces any strong effect on the vaporization, either. It should be mentioned that the concentrate burner (description and figure on p. 5) mentioned in the specification is by its structure almost analogous to Lange's vertical burner (cf. A. Lange: Advances in Extractive Metallurgy, Elsevier 1968, 206–223, FIG. 4, p. 211). The examples in the patent specification do not give the necessary data concerning the total feed and the total air, the thermal losses determining the additional gas amount, etc. so that the vaporization results given as examples in the specification cannot be evaluated by using known laws of nature. Nevertheless, according the patent, when the operation rate (i.e., the feed capacity of the furnace unit) is increased when manufacturing by the process a matte with a 30–40% copper concentration (concentrate 6–12 Pb, 17–30 Zn, 5–7 Cu), concentrations of 8–9 Zn, 0.8–1.2 Pb, 1–1.5 Cu in the slag can be expected, and the slag is treated in an electric furnace. The impurity concentrations in the matte are not given in the specification.

Cyclone smelting and processes developed from it constitute a very important group among the impurity vaporization processes. In the vaporization processes the apparatus technology is often crucial for the implementation and development of the process. The effective suspension vaporization and burning at the very high temperature in the cyclone and the flexible possibilities for varying the location and position of the cyclone are of decisive importance in vaporizing processes. The cyclone burner can be located in connection with the smelting furnace in such a manner that the combustion and vaporization gases can be directed out of the system without the gases coming into contact with the products of smelting. A description of the construction and placement of the cyclones (horizontal or vertical—gases withdrawn from the bottom or from the top—two-step cyclones, etc.) is given in, for example: I.M. Rafalovich, V.L. Russo: Tsvetnye Metally, 9, 1964, 30–39. The vaporization of impurity components (Re, Mo, Se, Te, Cd, Pb, Zn, Ge) in cyclone smelting when smelting copper and polymetallic concentrates is described in I.A. Onajew: Neue Hutte, 10, H 4, 1965, 210–216.

As to the cyclone vaporization of concentrates, the processes according to U.S. Pat. No. 3,555,164 and GFR Pat. 2 038 227 are discussed.

In the former process, the molten and solid material emerging from the vertical cyclone impinges against a dam wall below the cyclone, from where it flows into a matte-slag separation tank which is connected at one end to an electric furnace through a partition (communicating vessels). In the electric furnace the slag is purified and the vaporizing metals (Zn, Pb, etc.) are condensed from the gas phase. The gases emerging from the cyclone and the impurity components present in them (Pb, Zn, Cd, Se, Re, Hg, etc.) flow out of the system in a direction opposite to that of the molten and solid flow, directly into the dust and gas treatment devices.

The process according to the latter patent is an embodiment of the former. According to this process the concentrate is burned in the cyclone until it is completely devoid of sulfur. For example, the flying dust which contains part of the impurities is separated from the obtained gas phase and returned to the cyclone along with the feed. The molten and solid materials not containing sulfides pass, analogously to the previous process, from the dam wall into the electric furnace separated from the gas space by a partition. In the electric furnace the vaporizable components are separated from the oxide mass by reduction and recovered. Thus, in the process the bulk of the impurities is transferred to the oxide phase and not recovered until the electric furnace. The flying dust phase which is refed into the smelting system need thus not be treated separately.

An interesting application of the cyclone furnace is described in British Pat. No. 1,001,310. In the process, zinc is vaporized from the granulated slag of the lead shaft furnace by feeding it into a vertical reaction shaft by means of a cyclone. The carbon dust used as fuel and the air preheated by means of the furnace outlet gases (500°–550° C.) are fed by means of two tangential burners fitted at different levels in the reaction shaft.

Also worth mentioning is the roasting of pyrites and chalcopyrites, and the purification of the calcines, comprising many different vertical suspension processes. The aim is to remove sulfur, arsenic, antimony, and valuable metals from the calcines. The processes are usually one- or two-stage oxidation and reduction processes nearly always connected with a sulfating, chlorinating or vaporizing roasting. The processes are usually performed in fluidized-bed furnaces. Some examples of the latest technology are the processes according to U.S. Pat. No. 3,649,245 and Canadian Patent Nos. 890,343, 876,030, 885,378, and 882,585.

SUMMARY OF THE INVENTION

The present invention is based on the combination of an oxidizing and a reducing vaporization in a suspension composed of the concentrate and the reaction gases, flowing in a vertical reaction shaft.

DESCRIPTION OF THE INVENTION

Figure 1C:
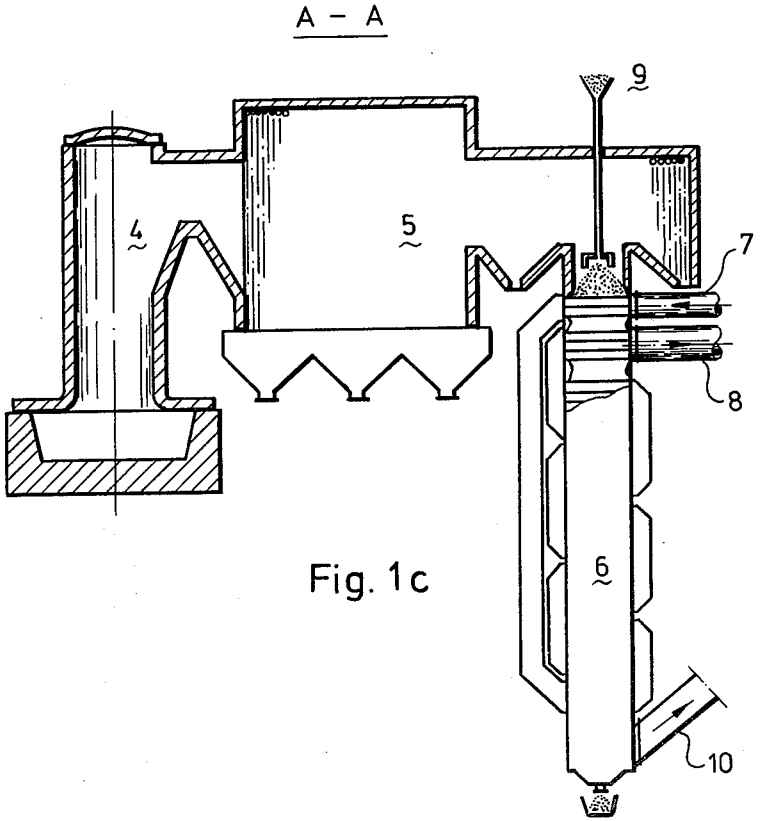
FIGS. 1*a–c* depict as a diagram with the necessary cross sections a suspension furnace system suitable for effecting the process. The numbered parts of the structures are as follows: 1 the concentrate disperser, 2 the oxidation-reduction reaction shaft, 3 the lower furnace, 4 the rising shaft, 5 the heat-recovery boiler, 6 the heat exchanger, 9 the sooting system, and 11 the feeding pipes for the reducing agent.

In the first stage of the process, in the upper part of the reaction shaft, the heavy metals and/or their sulfides are separated by annealing, by a process known per se, within, the temperature range 1500°–1600° C. Thereby the heavy metals vaporize in correspondence with their high vapor pressure and become detached from the sulfide matrix of the principal metals. The concentrate is oxidized in this stage to a degree corresponding to a very rich sulfide matte of the principal metal. Those impurity metals and sulfides which form stable oxides become oxidized after the vaporization and are thereby in a way removed from the reaction space, in which case the vaporization occurs continuously at a high pressure.

When the operation is performed by conventional technology, a very great portion of these solid or molten oxides produced during the oxidizing vaporization impinges together with the principal metal sulfide against the melt under the reaction shaft while the reaction gases change their direction. Thus most of these impurities again come into contact with the principal metal and participate in the matte and slag reactions.

According to the invention the reconcentration of the impurities in the final products is eliminated by again transferring the impurity metals in the form of metal and/or sulfide vapor into the gas phase during the second stage in the lower part of the reaction shaft. The products obtained by the oxidation process are converted by reducing and/or by fuel and sulfur dioxide of the oxidation gases. Thereby the reduction products of impurity metals have a high vapor pressure even at temperatures (1200°–1400° C.) lower than that of the oxidizing stage, because during the oxidizing vaporization they have formed pure suspension-stage metal vapors and solid or molten metal oxides. The delay period of the gas phase obtained by conversion and containing the metals or their sulfide vapors in the horizontal flow of the lower furnace is so short that the equilibrium in regard to the lower furnace melt consisting of the produced basic metal sulfide and the slag components does not have time to stabilize because the reaction surface is very small compared with the suspension-state system. Thus the oversaturation of the impurity metals or their compounds in the gas phase is stable in relation to the lower-furnace products.

In the process according to the present invention the aim during the first stage of the refining of complex ores, i.e., the suspension smelting, is thus to direct most of the impurity components or metals into the flying-dust or gas phases as metal compounds or metals. In the process the impurity components are vaporized by a two-stage suspension treatment in a vertical reaction shaft. In the first treatment stage an effective vaporization-oxidation of the suspension is performed in the upper part of the reaction shaft. Thereby the vaporization products, in accordance with their stabilities, remain in a gaseous state or, which is usual, condense into melts or solid oxides. During the second treatment stage the vaporization-oxidation products in suspension are reduced and/or sulfidized effectively. Thereby the impurity components are reconverted to gaseous state and are not separated from the gas phase until outside the furnace. The retention time of the suspension in each of said treatment stages is brief, about 1 to 2 seconds.

The different stages of the process according to the invention are characterized by the following operations:

Vaporization-oxidation stage: The vaporizing oxidation is the application of an almost conventional suspension smelting technique to a complex concentrate. By means of preheated air a sulfide concentrate is oxidized in such a manner that the obtained product of oxidation is at a high temperature (1400°–1600° C.). When the suspension heats up, the heavy metals and/or their sulfides, with a high vapor pressure, pass out of the sulfide matrix of the main metal and become oxidized. The saturation equilibrium corresponding to the vaporization temperature in regard to the vapor phase is not reached because the vaporization usually converts to oxide and thereby withdraws from the place of reaction. For effective vaporization the oxidation must be performed to such a degree as to produce a shaft product corresponding to a high-grade sulfide matte of the main metal. The iron in the sulfide concentrate must be oxidized to a maximal degree so as to make it possible to separate, either as a solid or vaporizable oxide, part of the impurities not vaporizable as metal or sulfide from the sulfide phase of the basic metal.

It should be noted in particular that the quantitative vaporization of an impurity component which forms a stable complex compound is usually not successful. Therefore these complex compounds must be dissociated and the minerals rearranged, in which case the greater part of some of the impurities are removed in advance and some remain in the sulfide matrix in the form of easily vaporizable independent and/or simple sulfide mineral structures. One process suitable for the rearranging of complex mineral crystals is that according to U.S. Pat. Application Ser. No. 587,662.

Reduction-vaporization stage: The reducing vaporization is necessary because otherwise the solid or molten impurity metals or their oxides separated from the sulfide matrix in the vaporizing oxidation impinge against the lower-surface molten phase in the vertical smelting and, when participating in the matte-slag reactions, come again into contact with the main metal. Thereby especially the impurities which are present as valuable trace elements are irrevocably lost in the slag phases. The reducing vaporization, after oxidation, is performed in the lower part of the reaction shaft by spraying a fossil reducing agent into the suspension.

Depending on the thermodynamic properties of the impurity metals they dissociate at the reduction stage from their metal or oxide states formed during the oxidation and are retransferred into the vapor phase, whereby their impinging against the molten phase in the lower furnace is prevented. Since, for example, the sulfide vapor produced within the sulfide stability range from an independent impurity component oxidized into the suspension state corresponds to an equilibrium in regard to pure sulfide, its vapor pressure also corresponds to a sulfide activity close to one. This impurity vapor phase does not have time to stabilize in regard to the main metal sulfide precipitate or the lower-furnace melt with a small reaction surface, but proceeds, often greatly oversaturated in relation to them, through the rising shaft out of the system along with the rest of the gas phase.

The reduction and sulfidization velocity can be strongly "catalyzed" by, for example, the use of a solid reducing agent with the help of a very high momentary sulfur potential out of equilibrium, produced in suspension.

The process according to the new invention can be greatly varied, depending on the type of impurities, the principle of the vaporizing oxidation and reduction of the suspension being, however, crucial.

The aim of the process according to the invention is, in suspension smelting, the direct, in the form of compounds or metals, the bulk of the valuble metals present in complex and mixed concentrates and ores into the flying dust and gas phases, from which they can easily be recovered by different known methods. Some components covered by the process which are considered impurities—quantitatively—in regard to the main components (Cu, Ni) in the ore matrix are Zn, Cd, Hg, Ga, In, Tl, Ge, Sn, Pb, As, Sb, Bi, Mo, W, Mn, Re. When the suspension smelting is performed by conventional methods, a considerable portion of the said impurities ends up in the matte and slag phases, from which they are very difficult to separate and the further processing of which is often effectively disturbed by the impurities.

The process according to the invention is effected in a conventional suspension smelting apparatus comprising a vertical reaction shaft. The process is based on a combination of an oxidizing and a reducing vaporization of a shaft suspension containing the suspension or ore. According to the process, a strong oxidation of the concentrate into a shaft product corresponding to very high grade sulfide matte (Cu, Ni) is performed in the upper part of the reaction shaft. At high temperature the heavy metals, or their sulfides, having high atomic numbers and being therefore easily vaporizable are separated and pass into the oxidizing gases in proportion to their vapor pressures, most of the impurities being thereby oxidized. The dissociation of the sulfides or metals from the sulfide matrix is thus continuous, since the vaporization is removed from the place of reaction as a reaction product. In many cases the vapor pressure of an oxidic metal compound is lower than that of the sulfide, so that the condensation of the compound occurs in the gas phase (e.g., Zn and Pb). In vertical suspension smelting performed by conventional methods the condensates impinge against the melt surface in the lower furnace, while the vertical gas flow changes its direction to follow the melt surface in the lower furnace. Thereby a considerable part of the condensate is removed from the gas phase.

In the process according to the invention the suspension is reduced by means of fossil fuel before the gas phase (suspension) changes direction, so that the impurity oxides separated from the sulfide matrix and oxidized during the oxidation are reconverted to gaseous sulfides or metal vapors and thereby accompany the gas phase, from which they are not recovered until outside the furnace.

The ores falling within the sphere of the process have mainly been created as a result of late magmatic differentiation. Some of the mineralizations (e.g., magnetic pyritepentlandite paragenesis, stable arsenic and antimony minerals of platinoids, etc.) segregated under the effect of the melt-melt solubility gap of the latter stage of the early magmatic phase are covered by the process. The greater part of the ores within the range of the process are, however, derived from the differentiation of the remanent eutectic of the latter phase and in addition, as a mineralization by the low temperature and pressure of that phase (i.e., the slowly crystallized, well-mineralized complex and mixed ores, etc.). In this case, those ores that are involved are, in the order of importance, pegmatitic (e.g., molybdenum and copper glances), pneumatolytic (e.g., copper and arsenic pyrites, lead glance, zinc blende, and pyrites), contact metasomatic (e.g., copper and arsenic pyrites, pyrite, lead and iron glances, zinc blende, and selenium and bismuth minerals of noble metals), and hydrothermal deposits. Most of the ore mineralizations covered by the process appear specifically as hydrothermal deposits. Some of these groups and some minerals of the groups are discussed below by classifying them mainly on the basis of their composition.

a. Pyritic and arsenic-rich groups
(Fe,Co,NI)

$$\begin{bmatrix} (S, Se, Te, As)_2 \\ (As, Sb, Bi)S \end{bmatrix}$$

$Cu(Fe,Ga,In)S_2$
$Cu_3(Ge,Fe,As,Sb)S_4$ b. Lead, zinc, silver groups
$(Cu,Ag)_{20}(Fe,Zn,Hg,Ge,Sn)_4(As,Sb,Bi)_8S_{26}$
(Zn,Cd,Hg) (S,Se,Te)

c. Tin, zinc, silver groups $$\begin{bmatrix} Cu_3(As, Sb, Fe, Ge, V) \\ Cu_2(Ag, Fe, Zn, Sn) \end{bmatrix} S_4$$

d. Arsenic, antimony, bismuth complex ores $$\begin{bmatrix} Cu(Sb, Bi) \\ Ag(As, Sb) \end{bmatrix} S_2$$

-continued $$\begin{bmatrix} Ag_3(As, Sb) \\ Cu_3(Bi) \\ Cu(As, Sb, Bi) \end{bmatrix} S_3$$

In addition to natural minerals, the process also covers, of course, the precipitates containing synthetic parts of the above mineral groups, produced as by-products in industrial processes.

The structures of the complex compounds present in the ores used in connection with the suspension oxidation-reduction-vaporization process should be relatively simple since, owing to the activity conditions, the vapor pressure of a vaporizing impurity component may be very low when it is combined, for example, with the main metal. The ideal conditions for the vaporization are those in which an impurity compound forms an independent sulfide. In such a case the oxidizing vaporization in suspension can be performed even at a relatively low temperature, and furthermore, the oxidation degree of the shaft product need not correspond to a very high-grade sulfide matte of the main metal. Vaporizable products can, however, easily be obtained from the above complex structures, which are quite numerous in regard to the vaporizable metal and have low vapor pressures, by rearranging the mineral crystals. The sulfide rearrangement process according to commonly assigned United States patent application Ser. No. 587,662 filed June 17, 1975, for example, is very suitable for this purpose. The pretreatment of a concentrate or ore by this process also offers the advantage that, when the quantity of impurities is great, some of them can be reduced or removed entirely before the vaporizing suspension process.

We shall first discuss the basis of the process according to the invention and its implementation when smelting a structuraly simple copper concentrate. Finally the rudiments of applying the process are discussed when treating polymetallic sulfidic complex concentrates.

The material balances and analyses corresponding to the trial run (feed rate: 20 t/h) of zinc- and lead-bearing copper concentrate (also small quantities of nickel and cobalt) first discussed in this connection, as well as the thermal balance and the gas phase compositions of the partial processes, are given in Tables A, B, and C.

According to Tables A and B the temperature of the post-oxidation shaft product was 1500(±25)° C. The oxidation corresponded to the composition of a shaft product required for the production of a sulfide matte with a copper content of approx. 70% Cu by weight. The quantity of the gas phase obtained by oxidation was 25 780 $Nm^3$, i.e., 1289 $Nm^3$ per one ton of concentrate.

At 1500° C. the pure zinc sulfide is completely dissociated into metal vapor and sulfur vapor $$(1)\ 2ZnS(s) \rightleftharpoons 2Zn(g) + S_2(g)$$

The equilibrium constant of the equation (1) and its available energy are of the form $$(2)\ -\Delta G^\circ/M^{-1}RT = -39156/T + 20.1069$$

The total pressure obtained for the sulfide dissociation is thus $$(P[mmHg] = 3/2p_{Zn} = 3p_{S2})$$

$$(3)\ \log P = -13026/T + 9.8428$$

The dissociation pressure of pure zinc sulfide at 1500° C., calculated from Equation (3) is P=313 mmHg, of which the proportion of zinc is $P_{Zn}$=209 mmHg.

The activity of zinc sulfide in the $Cu_2S$—FeS—ZnS mixture is within the range $$(4)\ a_{ZnS} = N_{ZnS} \exp[M^{-1}T^{-1}(1560-385 N_{Cu2S})(1-N_{ZnS})^2]$$

Table A.

| Process / Component | Material balance of the trial run under discussion — Analysis, % by weight: Cu | Zn | Pb | Fe | $Fe^{+3}$ | S | O | $SiO_2$ | $O_x$ |
|---|---|---|---|---|---|---|---|---|---|
| Shaft oxidation process | | | | | | | | | |
| Feed: Concentrate 1000.0 kg, sand 136.3 kg, air 1375 $Nm^3$ | | | | | | | | | |
| Product: Shaft oxidation product (1) 973.0 kg, gas phase 1289 $Nm^3$ | | | | | | | | | |
| Shaft reduction process | | | | | | | | | |
| Feed: Shaft oxidation process product, carbon dust 44.1 kg | | | | | | | | | |
| Product: Shaft reduction product (2) 883.7 kg, gas phase 1367 $Nm^3$ | | | | | | | | | |
| Lower furnace process | | | | | | | | | |
| Feed: Shaft reduction process product, carbon dust 55.3 kg, air 438 $Nm^3$ | | | | | | | | | |
| Product: Matte 295.5 kg, slag 525.2 kg, flying dust 156.0 kg, gas phase 1832 $Nm^3$ | | | | | | | | | |
| Analyses | | | | | | | | | |
| Concentrate | 20.50 | 7.50 | 1.20 | 28.74 | — | 34.56 | — | 5.00 | 1.60 |
| Sand | — | — | — | 0.70 | 0.70 | — | (0.30) | 91.74 | 5.38 |
| Shaft product (1) | 21.07 | 7.71 | 1.23 | 29.64 | 17.93 | 6.44 | 12.64 | 17.99 | 2.40 |
| Shaft product (2) | 23.20 | 0.68 | 0.04 | 32.63 | 16.95 | 9.98 | 9.98 | 19.81 | 2.64 |
| Matte | 65.00 | 0.40 | 0.25 | 10.44 | — | 21.09 | 1.29 | — | — |
| Slag | 1.05 | 1.14 | 0.06 | 46.66 | 4.03 | 1.10 | 13.84 | 32.00 | 3.65 |
| Flying dust | 4.74 | 43.47 | 7.01 | 7.98 | — | 28.28 | — | 4.49 | 2.8 |

Table B.

| Balance component | Heat balance of the trial run under discussion — Rate t/$Nm^3$ | Temperature °C. | Heat amount Mcal/h |
|---|---|---|---|
| Oxidation-reduction process | | | |
| In | | | |
| Concentrate | 20.000 | 25 | 19592 |
| Sand | 2.726 | 25 | −12 |
| Air | 27500 | 370 | 3052 |
| Carbon dust | 0.883 | 25 | 6849 |
| In total | | | 29481 |
| Out | | | |
| (Oxidation product) | (19.459) | (1500) | (7136) |
| (Oxidizing gas) | (25780) | (1500) | (14497) |
| Shaft product | 17.674 | 1400 | 8545 |
| Gas phase | 27345 | 1400 | 19088 |
| Thermal losses | — | — | 1850 |
| Out total | | | 29483 |
| Lower furnace process | | | |

Table B.-continued

| Heat balance of the trial run under discussion | | | |
|---|---|---|---|
| Balance component | Rate t/Nm$^3$ | Temperature °C. | Heat amount Mcal/h |
| In | | | |
| Shaft product | 17.674 | 1400 | 8545 |
| Gas phase | 27345 | 1400 | 19088 |
| Carbon dust | 1.105 | 25 | 8578 |
| Air | 8762 | 25 | — |
| In total | | | 36211 |
| Out | | | |
| Matte | 5.910 | 1250 | 4911 |
| Slag | 10.504 | 1300 | 3890 |
| Flying dust | 3.120 | 1300 | 3743 |
| Gas phase | 36630 | 1300 | 22666 |
| Thermal losses | | | 1000 |
| Out total | | | 36210 |

Table C.

| Gas phases of the trial run under discussion | | | |
|---|---|---|---|
| Component | Gas composition, % by volume | | |
| Process | Oxidation | Reduction | Lower furnace |
| $H_2$ | — | 0.12 | 0.14 |
| $H_2O$ | 0.53 | 1.44 | 2.13 |
| $H_2S$ | — | 0.02 | 0.03 |
| CO | — | 1.16 | 1.44 |
| $CO_2$ | — | 4.13 | 7.45 |
| COS | — | 0.01 | 0.02 |
| $S_2$ | — | 0.91 | 0.78 |
| $SO_2$ | 15.34 | 11.22 | 8.62 |
| $O_2$ | 0.20 | — | — |
| $N_2$ | 83.92 | 79.16 | 78.03 |
| Zn | — | 1.73 | 1.29 |
| "PbS" | — | 0.09 | 0.07 |
| $P_{O2}$, atm | $2.00\times10^{-3}$ | $3.44\times10^{-8}$ | $5.48\times10^{-9}$ |
| T, °C. | 1500 | 1400 | 1300 |

The activity of zinc sulfide in the melt is thus far higher than that corresponding to an ideal mixture.

Provided that all the zinc present in the concentrate (Table A) vaporized into the fuel gas volume corresponding to the example, its partial pressure would be $P_{Zn}=15.2$ mmHg, i.e., the gas phase would contain zinc approx. 2.0% by vol. In this case the zinc concentration in the sulfide phase of the oxidized shaft product corresponding to the example at 1500° C., calculated from the activities (4) and vapor pressure (3) in an equilibrium with the gas phase ($P_{Zn}=15.2$ mm) would correspond to the value Zn 0.70% by weight. In a pure $Cu_2S$-Zns mixture the stable content in conditions corresponding to those above would correspond to the value Zn 0.72% by weight.

In the oxidation process, however, the zinc vapor passing into the gas phase is oxidized immediately upon leaving a sulfide particle, and because it thus "leaves" the reaction place the equilibrium pressure is theoretically never reached. Thus the vaporization can also become almost complete, depending on the time factor, e.g., when the zinc content in the concentrate corresponds to that in the example, which is still low. In a case corresponding to the example, zinc still remains in the shaft sulfide in an amount of approx. 1.2% because of rapid technical oxidation. This concentration is, however, very low since the total sulfide amount has lowered during the oxidation from 979.6 kg to 271.0 kg.

The solid zinc oxide obtained by oxidation by conventional suspension smelting, when using a vertical shaft, impinges against the lower-furnace melt surface and together with the other components participates in the lower-furnace reactions and in the matte and slag formation. The matte and slag phases produced in the lower furnace from an oxidized shaft product corresponding to Table A would have the following compositions (Me % by weight): Matte: 70.00 Cu, 1.40 Zn, 0.99 Pb, 5.27 Fe, 20.65 S, and 0.85 O; Slag: 4.03 Cu, 9.29 Zn, 1.24 Pb, 35.81 Fe, 0.20 S, and ~14.4 O. The $Fe_3O_4$ concentration in the slag would be 18.6% in solid state and the $Fe^{+2}/Fe^{+3}$ ratio would correspond to three. (The silicic acid concentration in the slag, 30.7% by weight $SiO_2$).

In the new vaporization-smelting process under discussion the zinc separated from the sulfide matrix by vaporizing oxidation is not allowed to discharge in an oxide form into the lower furnace melt but is reconverted to vapor before the gas phase particles impinge against the lower furnace (FIG. 1) melt surface. This conversion is performed by reducing the suspension by means of a fossil fuel before the gas phase turns to the horizontal direction.

When the oxidation is performed with technical air, the partial pressures of oxygen, sulfur and sulfur dioxide (Table C: atm) in the post-oxidation gas phase in a case corresponding to the example are as follows: $p_{O2}=2.00\times10^{-3}$, $p_{S2}=9.41\times10^{-11}$, and $p_{SO2}=1.53\times10^{-1}$. In the potential diagram (FIG. 2) this point is indicated by H. In regard to the stability fields the position of point H at 1500° C. is the same as the temperature corresponding to the figure, 1400° C. In regard to the $SO_2$ isobar in the figure, $P_{SO2}=0.1$, point H is somewhat too high. The post-oxidation reduction occurs in a case corresponding to the example somewhat above the isobar, $P_{SO2}=0.1$. When reduction occurs, the temperature of the suspension drops approx. one hundred degrees, the calculated temperature after the reduction being 1400° C. The $SO_2$ isobar, 0.1, according to the figure intersects the stability field of metallic copper. Metal is, however, not produced in a greater amount than that corresponding to the equilibrium solubility (1400° C.; Cu(l)-$Cu_2S$(l), copper approx. 4.1% of the sulfide amount), which is usually resulfidized as the reduction continues. The cuprous oxide in the shaft product is naturally also sulfidized. According to the diagram (FIG. 2), when the partial pressure of oxygen lowers, the isobar intersects the ZnO(s)-ZnS(s) equilibrium, in which case ZnO(s) is dissociated and the zinc in suspension passes into the gas phase (2 Zn(g))+$S_2$(g). According to the potential diagram, the quantitatively considerable conversion of the solid magnetite in the shaft product to molten iron sulfide does not begin until after this.

The presently preferred operating conditions, as will more fully appear from the following detailed discussion, constitute oxidizing at a temperature of 1400°-1600° C. under a partial pressure of sulfur dioxide of 0.08 to 0.20 atmospheres and a partial pressure of oxygen of $10^{-3}$ to $10^{-2}$ atmospheres in the upper part of the reaction zone. Reducing or sulfidizing treatment, or both, are carried out at a temperature of 1300°-1400° C., partial pressure of sulfur dioxide of 0.08 to 0.20 atmospheres and a partial pressure of sulfur of $10^{-4}$ to $2.10^{-2}$ atmospheres in a lower part of the reaction zone over substantially the entire cross-sectional area of the gas space in such lower part of the reaction zone. These parameters can be calculated from the numerical values and diagrams herein.

In connection with the process according to the invention it must be noted in particular that it utilizes the conversion of an almost pure independent oxide which has passed into the suspension by oxidation from the gas phase. The vapor phase produced by reduction thus represents an equilibrium in regard to a sulfide with an activity of one and not in regard to a sulfide mixture with an activity lower than this. When the shaft oxidation is performed, ferrites of zinc are also formed, but after the reduction, ferrites and mixture sulfides are usually present in very small concentrations only. Some secondary Zn-Fe-S formation may occur but there is not a sufficient delay period for the iron sulfide amount reduced from the suspension to stabilize in regard to the gas phase before the sulfide of the suspension impinges against the melt surface.

The composition of the Cu-Fe-Zn-S phase produced when the original chalcopyrite oxidizes remains almost unchanged in the suspension. The concentration of sulfur in the sulfide mixture may slightly increase when the sulfides are stabilized in the reduction. At 1400° C. the total pressure generated by pure zinc sulfide is P=114 mmHg, of which the share of zinc is 76 mmHg. It can thus be noted that the zinc vapor produced in the conversion from pure oxide remains in the gas phase quite well and thus a solid sulfide is not produced. After the oxidation the zinc sulfide concentration in the shaft sulfide is 2.73 mol%, from which the activity $a_{ZnS}=0.136$ is obtained by using Equation (4), and thus the equilibrium pressure is $P_{Zn}=10.3$ mmHg. The zinc vapor pressure in the post-reduction gas phase (Table C) is $p_{Zn}=13.2$ mmHg. Thus, only a very slight zinc concentration increase would occur in the shaft sulfide if a delay period were available for stabilization. It should be noted that a concentrate corresponding to the example has a relatively low zinc content (7.5% by weight Zn).

An equilibrium between the iron sulfide melt produced when the shaft product magnetite in suspension sulfidizes and the zinc in the gase phase (Equation 4) would require a zinc content of 1.7% in the sulfide. Since the increase in the FeS rate during the reduction is in the example case only approx. 8.6% by weight, the alloying of the iron sulfide to correspond to the gas equilibrium, provided the time were sufficient, would have very little significance.

Figure 3:
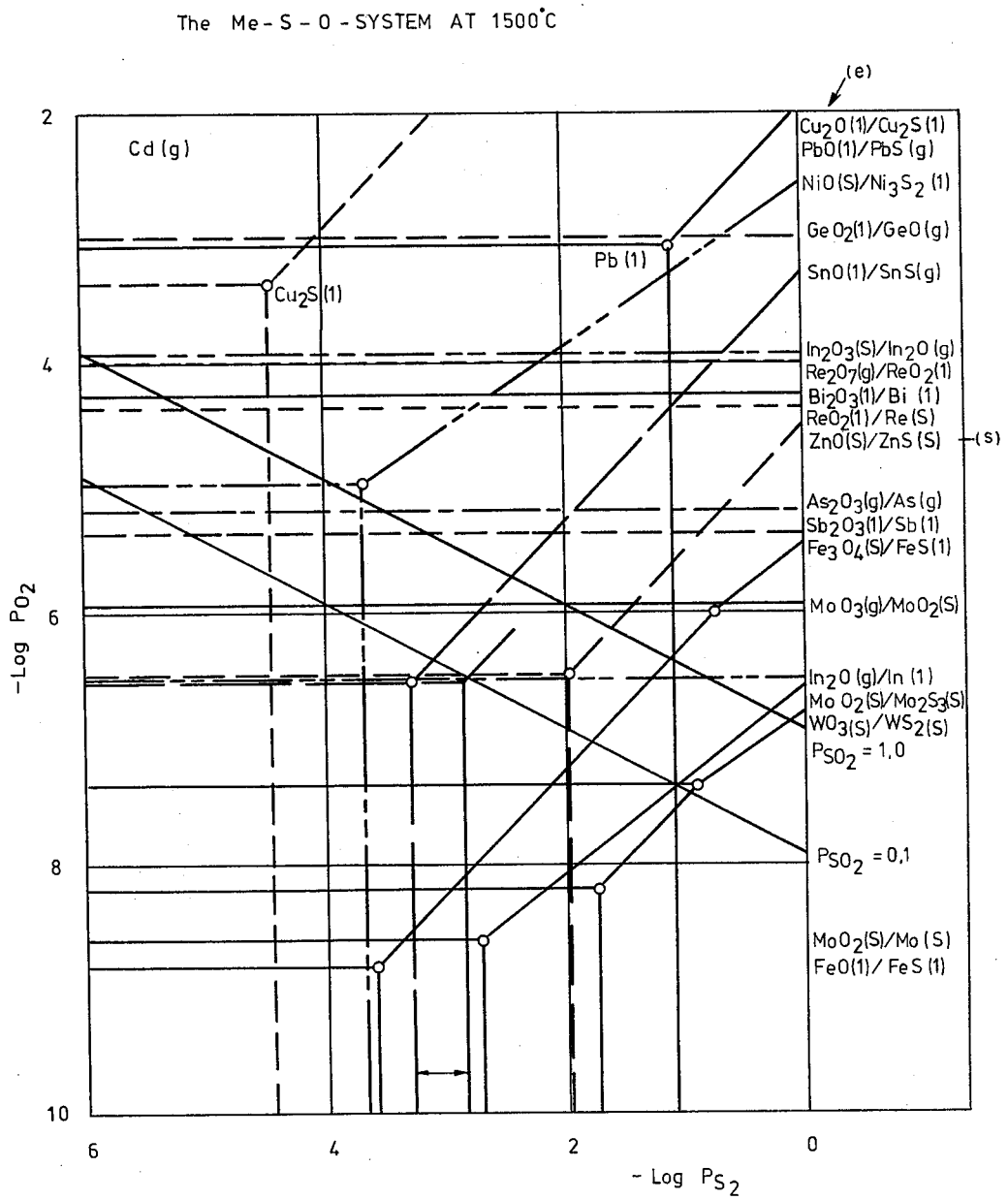
FIGS. 3 and 4 depict the system Me-S-O at 1500° C. and 1300° C. The potential diagrams corresponding to FIG. 2, at 1500° C. and 1300° C., have been calculated for the components mainly concerned in the process or their group representatives, i.e., Cu, Fe, Ni, Zn, Cd, In, Ge, Sn, Pb, As, Sb, Bi, W, Mo, Re. The exact thermodynamic values of some of the components are partially or entirely unknown.
Figure 4:
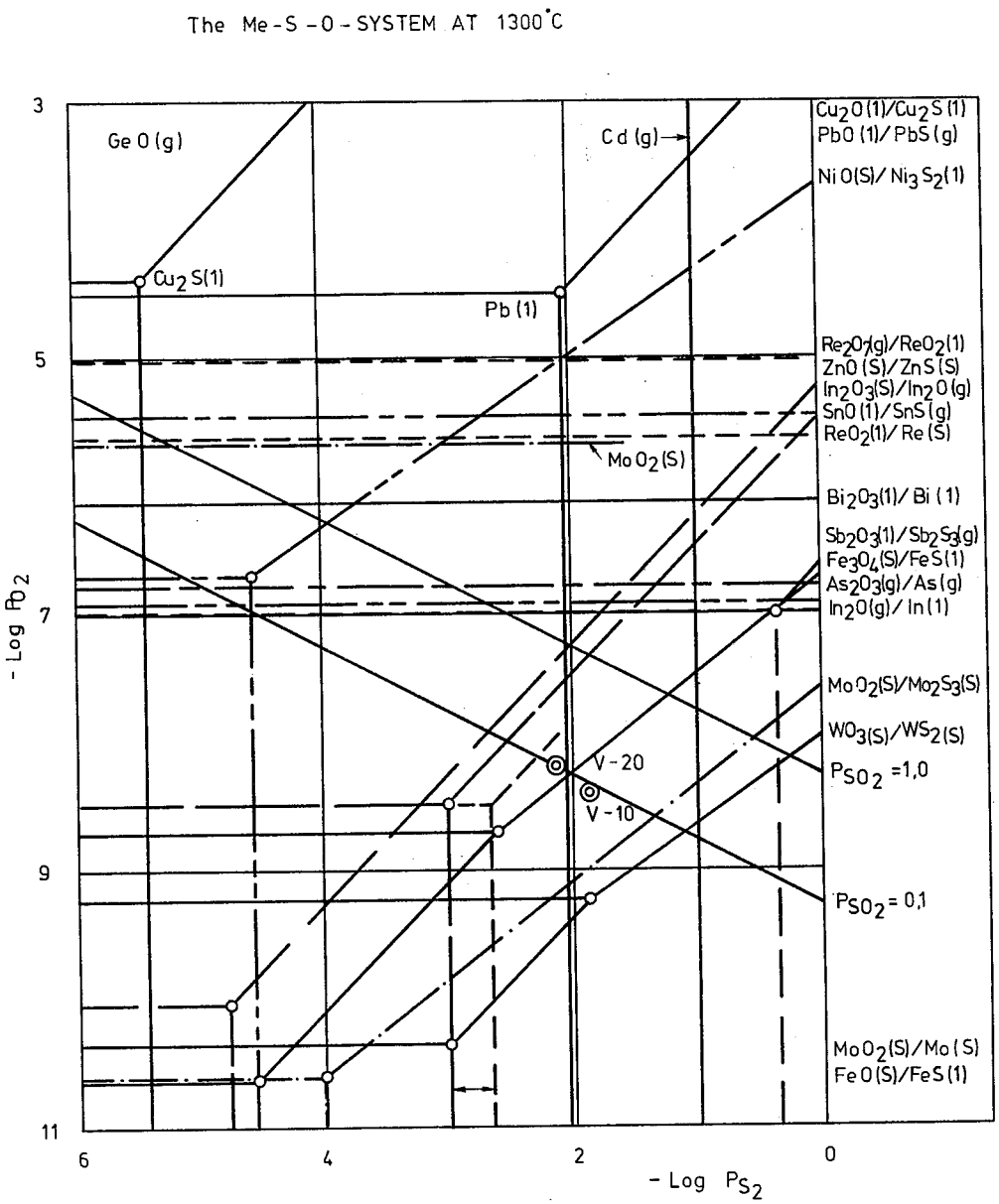

It should also be noted that after the gas phase changes direction the zinc remaining in it stays with the gas phase in the lower furnace and the rising shaft regardless of how it is combined (FIGS. 1, 3 and 4).

The behavior of lead in the oxidation-reduction process is discussed briefly. The vapor pressure of pure lead sulfide is high, i.e., 0.48–19.0 atm, within the temperature range of the process, 1200°–1600° C. Lead sulfide reaches the pressure of one atmosphere at a temperature of 1280° C. already.

In the system FeS-PbS the activity of lead sulfide within the range $N_{PbS}=0.0$–$0.3$ almost corresponds to an ideal system and is thus also independent of the temperature. An analogous situation prevails in the $Cu_2S$-PbS system. The activity of lead sulfide is approximately of the form $$(5)\ a_{PbS}=0.60\,(1-N_{Cu2S})^{1/2}$$

Figure 5:
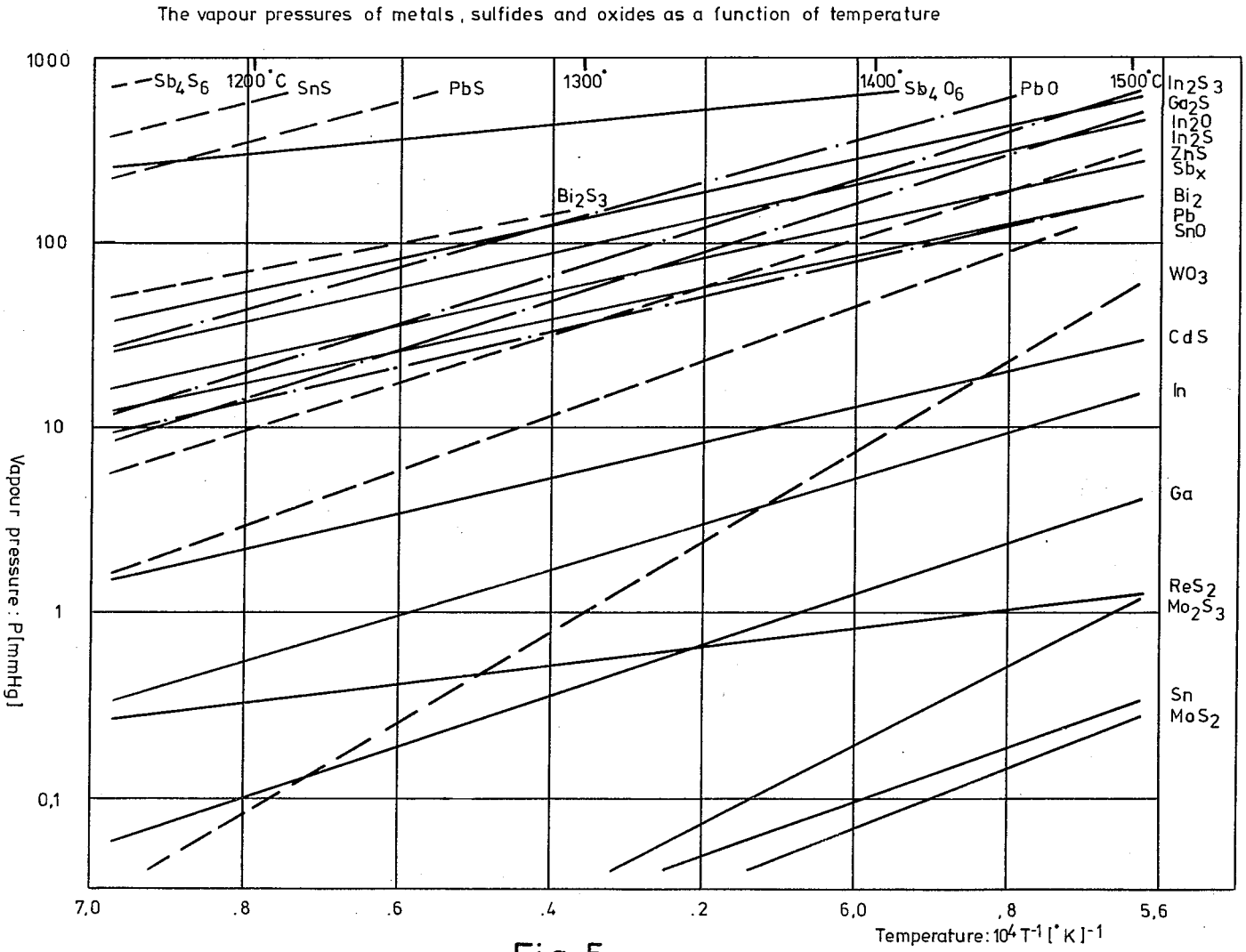
FIG. 5 depicts, as functions of the temperatures, the available vapor pressure of the metals and their compounds covered by the process.

The partial pressure of sulfide in a gas phase, in equilibrium with the shaft sulfide, is thus approximately $P_{PbS} \cong N_{PbS}P^{\circ}_{PbS}$. Lead sulfide can thus be vaporised from the sulfide mixture to very low concentrations even without the gas phase sulfide being oxidized. The lead oxide obtained as a product of oxidation also has a very high vapor pressure (FIG. 5) so that very great lead concentrations remain in the gas phase without the gas phase being reduced.

Figure 2:
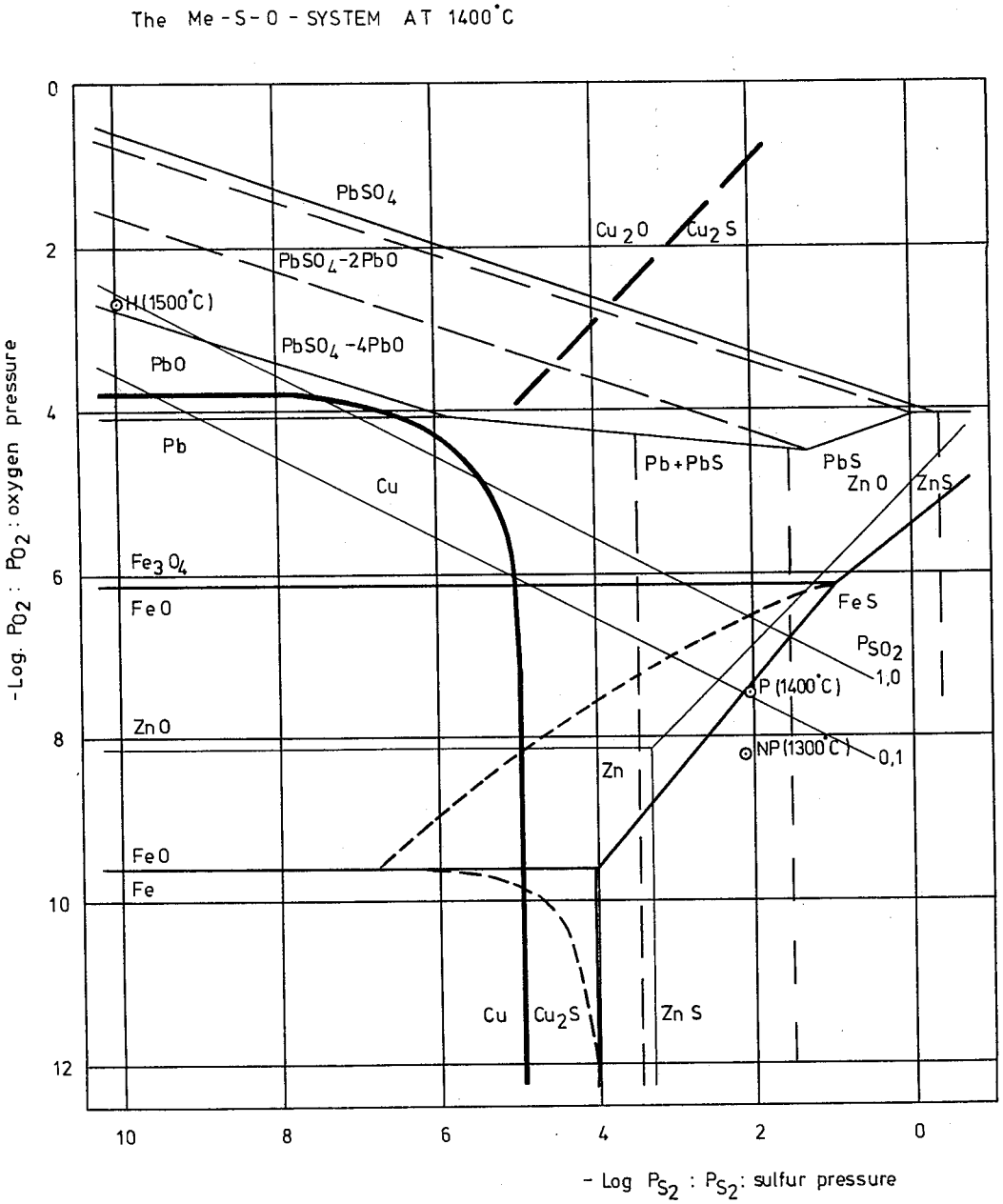
FIG. 2 depicts the system Me-S-O at 1400° C., calculated by means of known thermodynamic functions. The equilibrium diagrams of the systems (Cu, Fe, Zn, Pb)-S-O corresponding to the example, at 1400° C., are given as functions of the sulfur and oxygen pressures in the atmosphere.

The boundaries of the oxysulfates of the Pb-S-O system are indicated in the potential diagram in FIG. 2. It is, however, a homogeneous melt that is concerned. The oxysulfate-sulfate boundary is, however, real. There is no solubility gap in the system PbS-Pb, but the mixing of the melts is complete. The sulfur isobars in the diagram indicate different PbS activities in the melt. When the gas phase is reduced, metallic lead is thus produced from lead oxide according to the $SO_2$ isobars that are possible. When the reduction continues, however, a sulfide in vapor state is produced even at a relatively low reduction degree of the gas phase. It should also be noted that the vapor pressure of metallic lead is high within the operation range so that part of the lead may be carried in metallic form in the gas phase. In spite of the advantageous vapor pressures of its compounds, lead does not, however, withdraw quantitatively from smelting products without effective reduction-sulfidization. This is because the lead oxide produced in the oxidation easily reacts in the shaft with the concentrate or with the silicic acid present in the feed additives. The reduction and sulfidization of lead from molten silicates is difficult owing to the disadvantageous activity conditions. Some of the difficulties can be eliminated if the slag oxide is not added until after the reduction zone.

The amounts and analyses of the reduced shaft product, the produced sulfide matte, slag, flying dust, and gas phase in the example case are given in Tables A, B, and C. In the potential field in FIG. 2 the position of the reduced suspension is indicated by P. The position of the rising shaft gas equilibrium (temperature 1300° C.) is indicated by NP in the diagram. In the potential field of the temperature 1300° C. the position of NP is somewhat below the $SO_2$ isobar 0.10, but in regard to the compounds it is in a position corresponding to FIG. 2.

Finally, the behavior of polymetallic concentrates in a vaporization process according to the invention is discussed. Zinc and lead are present in many ores usually in concentrations much lower than the other valuable metal impurities. The mechanism of the vaporization of these impurities is often completely unclear and usually based only on technical experimental results. The enclosed diagram, Table D, illustrates the probable behavior of certain heavy metals, and the sulfides and oxides of the same, in an oxidation-reduction process. Since in the process under discussion the aim is to remove as many impurity metals from the concentrate as possible simultaneously and in the same apparatus, in which the possibilities for controlling the partial pressures of sulfur and oxygen are limited, it is not possible to obtain simultaneously the optimum conditions for the vaporization of each component. However, depending on the various impurities in concentrates, their concentrations, and the arrangement of the sulfide matrix, conditions advantageous for a considerable vaporization of the components can, however, often be obtained in terms of both the number and quantity of the components, and furthermore, with a very good efficiency.

The polymers or complex vapors of metal sulfides and oxides cannot be covered in this discussion. Sufficiently precise thermodynamic values are not available for a considerable number of the components, so that some of the empirical results are difficult to be even approximated mathematically. Some of the most common group components of the impurities are, however, discussed.

Cadmium and mercury behave partly analogously to zinc. The sulfides and oxides of both dissociate even at very low temperatures. The dissociation equilibriums of cadmium sulfide and cadmium oxide are

(19) 2CdS(s): $\log k = -32484/T + 19.3092$

(20) 2CdO(s): $\log k = -37291/T + 20.7524$

At the vaporization temperature 1500° C. the total pressure of the sulfide system is $P = P_{Cd} + P_{S2} = 4.03$ atm, and in the oxidation following the vaporization the total pressure of the oxide dissociation is respectively $P = P_{Cd} + P_{O2} = 1.52$ atm. In each case the cadmium can thus be assumed to be completely in the gas phase in the form of metal vapor.

In the final equilibrium corresponding to a temperature 1300° C. in the reducing vaporization (Example I) the total pressures obtained from Equations (19) and (20) are respectively $P_{CdS} = 0.67$ atm and $P_{CdO} = 0.18$ atm. Thus the gas phase continues to contain the metallic cadmium, the vapor pressure of which may, in an equilibrium with the shaft suspension, rise very high because the activity of cadmium sulfide in sulfide melts deviates, as does that of zinc sulfide, from the ideal in the positive direction. Even in the reduction the oxygen pressure decreases sharply, while the sulfur pressure simultaneously increases (Example I: $P_{S2} = 1.4 - 0.77 \times 10^{-2}$ atm and $P_{O2} = 4.0 - 6.6 \times 10^{-9}$ atm).

(21) $In_2O_3(s) + 4\ In\ (l) \rightleftharpoons 3\ In_2O(g)$

The formation of gaseous di-indium oxide follows the equilibrium constant

(22) $In_2O(g)$: $\log P = -13282/T + 7.3110$

At 1500° C. and 1300° C. the $In_2O$ pressures calculated from the equation are 0.66 and 0.074 atm. Indium is thus easy to vaporize at a suitable temperature and oxygen pressure (in the system, indium has the maximum share of the total vapor pressure at a certain oxygen pressure as do, for example, germanium and tin).

In the process under discussion, especially when zinc and lead are present in large amounts, low oxygen pressures are used in order to recover them. In such a case $In_2O(g)$ is dissociated further and as a consequence the metal phase stabilizes (FIGS. 3 and 4). The indium content in concentrates is usually low (seldom hundreds of millionths) so that these quantities can well be carried in the gas phase since the vapor pressure of metallic indium is sufficient for it, as can be seen from FIG. 5.

The behavior of tin in the oxidation-reduction-vaporization is almost analogous to that of indium. The monosulfide and its polymers are stable in the oxidizing vaporization at a high temperature. The vapor pressure of monosulfide above its melt is of the form

(23) SnS(g): $\log P = 5.810 - 8877/T$

Extrapolated to the temperatures 1500° C. and 1300° C., the vapor pressures of monosulfide are respectively 6.36 and 1.47 atm. When the monosulfide oxidizes, the stable compound is, depending on the oxygen pressure, $SnO_2(s)$ or SnO(g) with its polymers.

In the reduction a gaseous monoxide is first formed according to Reaction (24) and Equilibrium Constant (25)

(24) $SnO_2(s) + Sn(l) \rightleftharpoons 2SnO(g)$

(25) SnO(g): $\log P = -15000/T + 7.7931$

Table D.

Vaporization diagram of impurity components

| No | Vaporization-oxidation-reduction products |
|---|---|
| 6 | CdS(1750[a,100atm], 980[c], 1380[b]) ⟶ CdO(1497[b], 900[d], 1559[c]) ⟶ Cd(321[a], 765[b]) |
| 7 | HgS(584[c]) ⟶ HgO(500[c]) ⟶ Hg(−39[a], 357[b]) |
| 8 | $Ga_2S_3$(1255[a]), GaS(965[a]), $Ga_2S$(800[a,d]) ⟶ $Ga_2O$(500[d], 660[a]), $Ga_2O_3$(1725[a]) ⟶ Ga(30[a], 2403[b]) |
| 9 | $In_2S_3$(1050[a]), 850[c]), InS(692[a], 850[c]), $In_2S$(653[a] ⟶ $In_2O$(327[a], 527[b]), InO(1052[a], 1727[b]), $In_2O_3$(1[a]) ⟶ In(157[a], 2000[b]) |
| 10 | $Tl_2S$(449[a], 729[c]) ⟶ $Tl_2O$(300[a], −0:1080[o], 1865[b], 493[c]), $Tl_2O_3$(715[a], 850[c]) ⟶ Tl(303[a], 1457[b]) |
| 11 | $GeS_2$(800[a], >600[c]), GeS(530[a], 430[c]) ⟶ GeO(959[a], 710[c]), $GeO_2$(1086–1115[a]) ⟶ Ge(937[a], 2830[b]) |
| 12 | $SnS_2$(600[d]), SnS(870[a], 1230[b]) ⟶ SnO(1080[d], 1527[b]), $SnO_2$(1850[c]) ⟶ Sn(232[a], 2260[b]) |
| 13 | $As_4S_6$(307[a], 707[b]), $As_4S_4$(320[a], 590[b]) ⟶ $As_4O_6$(315[a], 457[b]) ⟶ $As_x$(613[c], 814[a]) |
| 14 | $Sb_4S_6$(564[a], 1150[b]) ⟶ $Sb_4O_6$(656[a], 1550[c]) ⟶ $Sb_x$(630[a], 1380[b]) |
| 15 | $Bi_2S_3$(685[d], 750[a]) ⟶ $Bi_2O_3$(817[a], 1890[b]) ⟶ $Bi_x$(271[a], 1560[b]) |
| 16 | $MoS_2$(1185[a], 450[c]), $Mo_2S_3$(1100[d], 1200[c]) ⟶ $MoO_2$(2227[a]), $MoO_3$(795[a], 1155[c], 1257[b]) ⟶ Mo(2610[a], 550[b]) |
| 17 | $WS_2$(1250[d]) ⟶ $WO_2$(1430[b], 800[c]), $WO_3$(1473[a], 1827[b]) ⟶ W(3410[a], 5927[c]) |
| 18 | $Re_2S_7$(530[d]), $ReS_2$(1398[d]) ⟶ $ReO_2$(1202[a], 1000[d]), $ReO_3$(160[a], 900[d]), $Re_2O_7$(296[a], 250[c]) ⟶ Re(3180[a], 5627[b]) |

Temperatures of change (°C.), [a]melting point, [b]boiling point, [c]sublimation point, [d]decomposition point The behavior of cadmium in an oxidation-reduction-vaporization can be seen in the potential diagrams in FIGS. 3 and 4.

The very low sublimation points or vaporization temperatures of the sulfides of indium can be seen in the diagram of Table D. Very high vapor pressures thus correspond to the vaporization points. The vapor pressures of the sulfides $In_2S_3$ and $In_2S$ are given in FIG. 5. In vaporizing oxidation, indium is rapidly converted to stable solid trioxide. When the suspension is reduced, the indium trioxide again passes into the gas phase according to the reaction (21)

The pressure of the monoxide at, for example, 1400° C. is $P_{SnO}=0.067$ atm. The dissociation pressure of tin sulfide, as a function of the temperature, is low within the reduction range, i.e.,

(26) 2SnS(g): $\log P_{S2}=2821.8/T-4.4422$

In the reduction process of the invention tin deviates from indium in that at the low oxygen pressures of the system a gaseous monosulfide is produced instead of metal, and thus carrying tin even in large amounts in the gas phase is easy when operating according to the process. The behavior of germanium and tin is indicated in the potential diagrams 3 and 4.

During the oxidation stage the sulfides of arsenic, antimony and bismuth ($As_4S_6$, $As_4S_4$, $Sb_4S_6$, $Bi_2S_3$) are vaporized out of the sulfide matrix and oxidize into gaseous or liquid products ($As_4O_6$(g), $Sb_4O_6$(l), and $Bi_2O_3$(l)) with a high vapor pressure. In the reducing vaporization the oxides are reduced into metals since the dissociation pressure of the sulfides is very high. At the reduction temperatures these metals have, however, a high vapor pressure and usually also a high atomic number per one gas molecule, and thus these metals can be carried in large quantities in the gas phase. The stabilities of arsenic, antimony and bismuth, and of the compounds of the same, as functions of the oxygen and sulfur pressures are given in the potential diagrams in FIGS. 3 and 4 and the vapor pressures in FIG. 5.

The behavior of molybdenum, tungsten, and rhenium in a vaporization system according to the process is discussed briefly. The vaporization of molybdenum in the form of sulfides is scanty, which can be noted from the vapor pressures in FIG. 5. At the temperatures of the oxidizing vaporization each sulfide has, however, a sufficient vapor pressure to transfer the molybdenum in low concentrations into the gas phase. The trioxide produced by the oxidation has a very high vapor pressure (Table D), so that by roasting it under suitable conditions the molybdenum can be transferred into the gas phase (e.g., by a shaft product oxidation corresponding to high-grade sulfide matte according to the invention: selective oxidation) even without a preceding sulfide vaporization. The product that is stable up to 1300° C. in the strong reduction following the oxidation is molybdenum oxide in solid state, and finally trisulfide. When the concentrate contains small amounts of molybdenum it is possible to carry the molybdenum in the gas phase. Otherwise it is probable that it passes into the matte phase and especially the slag phase at a considerable rate. The same situation also prevails in regard to tungsten. The oxygen pressure difference between the solid or molten tungsten trioxide and the sublimating dioxide is so small that the use of the reduction range corresponding to the dioxide is technically difficult.

Rhenium can be caused to pass into the gas phase relatively easily because its sulfides have a sufficient vapor pressure for this purpose. A rapid raising of the temperature causes, however, the process to stop since the dissociation pressures of the sulfides are considerable, i.e.,

(27) $Re_2S_7$: $\log P_{S2}=-4800/T+5.979$

(28) $ReS_2$: $\log P_{S2}=-14640/T+8.759$

The temperatures corresponding to a sulfur pressure of one atmosphere are 530° C. and 1398° C. Of the sulfide oxidation products only the heptoxide ($Re_2O_7$) has a high vapor pressure. In the reduction process this oxide is converted even at a relatively high oxygen pressure to metal and dioxide ($ReO_2$(l)) with a low vapor pressure. Under reducing conditions rhenium is carried in the gas phase as a mechanical suspension and therefore often incompletely.

The stability ranges of the compounds of molybdenum, tungsten, and rhenium are indicated in FIGS. 3 and 4.

The vaporization mechanisms of heavy metals and their compounds are not sufficiently mastered by the science and technology of present-day level. The explanation of the vaporization mechanisms of polymetallic concentrates according to the process described above is highly deficient since, for example, the activities of sulfide solutions are not known and therefore the vapor pressures of components in equilibrium can only be estimated. It should be noted that a very important factor in the vaporization is the conversion of the vaporizable components of the concentrate to metal or oxide because thereby the problem of gas phase saturation is partly eliminated. Also noteworthy is the very finely divided state of the components, which partly prevents the components in a mechanical gas phase from passing quantitatively into the matte and slag phases.

As to the vaporization equilibriums, especially in reducing vaporization it should be noted that in the vertical shaft of the process the gas phase equilibrium of the suspension often does not have time to stabilize when the reduction is performed by means of, for example, carbon dust after the oxidation zone (nozzles 11, FIG. 1). The special thing about carbon dust is that the sulfur dioxide in the gase phase becomes reduced very rapidly and far beyond the equilibrium corresponding to the temperature in question (i.e., at the temperatures concerned, 1350°–1450° C., the gas phase momentarily contains only elemental sulfur and hydrogen sulfide). Especially in connection with those impurity components covered by the invention in the case of which the aim is to sulfidize the components to cause them to pass into the gas phase before it changes its direction, the above factor has been found to have an effective catalytic influence on the sulfidization velocity.

Figure 1A:
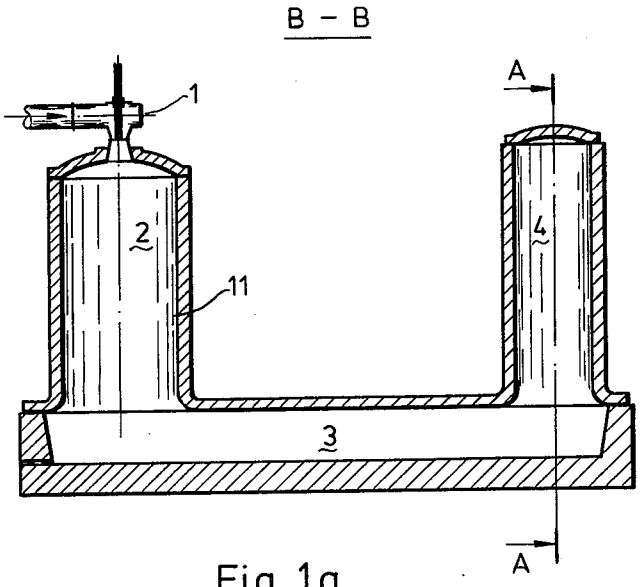
Figure 1B:
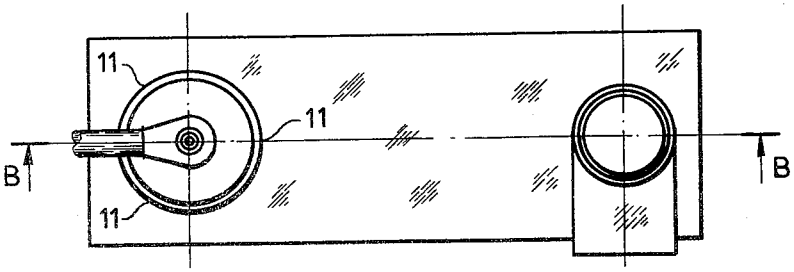

The process was performed in practice in the vertical suspension smelting apparatus shown in FIGS. 1*a–c*, the structural parts of which have been explained previously. The height of the reaction shaft 2 of the furnace was 8.0 m and its diameter 3.9 m. The height, width, and length of the lower furnace 3 were respectively 3.7, 5.0, and 19.5 m. The diameter and height of the rising shaft 4 were 2.8 and 9.0 m. The furnace was lined with chromium magnesite bricks and its shaft, lower furnace, and partially rising shaft were provided with either cooling plates or extraneous water cooling.

The smelting products were recovered from the lower furnace by discharging the matte and the slag from the furnace periodically. The minerals and metals in the gas phase were recovered from the heat recovery boiler 5 and from the convection heat exchange part 6, and the residual dust was recovered from the electric filters.

EXAMPLES

The analyses of the sulfide concentrates and sand used in the examples are given in the tables. The analyses of the fuels used for the reduction and for the heating of the lower furnace were as follows (% by weight):
light petroleum: 84.00 C, 16.00 H
carbon dust: 88.00 C, 3.00 H, 0.52 S, 8.84 ash
oil: 85.00 C, 11.80 H, 2.50 S, 0.10 $H_2O$

EXAMPLE I

In the test series corresponding to Example I a partly synthetic concentrate was used since all the components to be studied were not present in the basic concentrates. Ordinary technical air was used for the oxidizing vaporization in the upper part of the reaction shaft. The aim of the oxidation was a shaft product corresponding to a sulfide matte with a Cu content of approx. 75%. The material balances and product analyses corresponding to the test series, calculated per one ton of concentrate, are numbered in Table 1.

The products obtained from oxidized shaft product V without reduction were sulfide matte VII, slag VIII, and flying dust IX. The $SO_2$ content in the obtained oxidation gas phase was 15.6% by vol. The impurity components present in the concentrate passed into the flying dust phases in the following amounts (Me % by weight): 44 Zn, 80 Cd, 99 Hg, 50 In, 40 Ge, 40 Sn, 65 Pb, 79 As, 80 Sb, 94 Bi, 80 Mo, and 83 Re.

The suspension was reduced below the middle of the reaction shaft of the furnace by means of three pressure nozzles 11. Both light petroleum and coal dust were used in the reduction tests. In addition to the conversion of the products of the oxidizing vaporization, another aim of the reduction was to obtain a sulfide matte with a Cu content of approx. 60%. Therefore the reduction of shaft product V was relatively drastic. The products obtained from reduced shaft product XI were copper matte XIII, slag XIV, and flying dust XV. The yield of the impurity components in the concentrate into the flying dust phase was as follows (Me % by weight): 82 Zn, 93 Cd, 99 Hg, 70 In, 50 Ge, 90 Sn, 80 Pb, 88 As, 86 Sb, 95 Bi, 60 Mo, and 70 Re. The yields of zinc, cadmium, indium, tin and lead thus increased considerably, the yields of molybdenum and rhenium decreased slightly, while the yields of the other components remained almost the same or increased somewhat.

The mean analyses of the gas phases obtained in the reduction were as follows (% by volume):

Light petroleum reduction: 0.47 $H_2$, 6.19 $H_2O$, 0.15 $H_2S$, 1.03 CO, 4.53 $CO_2$, 0.01 COS, 1.40 $S_2$, 8.47 $SO_2$, 77.74 $N_2$, $P_{o2} \sim 4.0 \times 10^{-9}$ atm.

Coal dust reduction: 0.10 $H_2$, 1.69 $H_2O$, 0.02 $H_2S$, 0.96 CO, 5.46 $CO_2$, 0.01 COS, 0.77 $S_2$, 10.33 $SO_2$, 80.65 $N_2$, $P_{o2} \sim 6.6 \times 10^{-9}$ atm.

In the potential diagram in FIG. 4 the positions of the reduction gas phases are indicated by indices V-10 and V-20.

The industrial-scale material and thermal balances corresponding to the oxidation-reduction-vaporization Example I are given in Table 2.

Table 1.

Vaporizing smelting and reduction of complex concentrate

| Balance component | No. | Quantity kg | Analysis, % by weight Cu | Ni | Co | Zn | Pb | Fe | $Fe^{+3}$ |
|---|---|---|---|---|---|---|---|---|---|
| Feed | I | | | | | | | | |
| Concentrate | II | 1000.00 | 22.90 | 0.12 | 0.20 | 6.10 | 0.95 | 28.50 | — |
| Sand | III | 155.26 | — | — | — | — | — | 0.70 | 0.70 |
| Product (I): oxidation | IV | | | | | | | | |
| Shaft product | V | 990.66 | 23.12 | 0.12 | 0.20 | 6.16 | 0.96 | 28.88 | 17.53 |
| Product (II): oxidation | VI | | | | | | | | |
| Matte | VII | 267.50 | 74.01 | 0.30 | 0.17 | 0.80 | 0.33 | 2.98 | |
| Slag | VIII | 613.00 | 3.19 | 0.05 | 0.24 | 5.20 | 0.39 | 42.59 | 10.69 |
| Flying dust | IX | 91.00 | 12.58 | 0.07 | 0.11 | 29.63 | 6.84 | 18.71 | 12.47 |
| Product (III): reduction | X | | | | | | | | |
| Shaft product | XI | 1010.70 | 22.66 | 0.12 | 0.20 | 6.04 | 0.94 | 28.31 | 13.78 |
| Product (IV): reduction | XII | | | | | | | | |
| Matte | XIII | 354.05 | 60.01 | 0.32 | 0.47 | 0.55 | 0.38 | 14.40 | |
| Slag | XIV | 501.50 | 1.02 | — | 0.05 | 1.80 | 0.11 | 43.48 | 3.93 |
| Flying dust | XV | 8.54 | 0.05 | 0.08 | 37.29 | 5.67 | 12.70 | — | |

| No. | Analysis, ppm As | Sb | Bi | Sn | Ge | Cd | In | Hg | Mo | Mn | Re |
|---|---|---|---|---|---|---|---|---|---|---|---|
| I | | | | | | | | | | | |
| II | 4400 | 500 | 1100 | 500 | 4.0 | 150 | 12.0 | 6.0 | 1000 | 100 | 3.0 |
| III | | | | | | | | | | | |
| IV | | | | | | | | | | | |
| V | 4441 | 505 | 1110 | 505 | 4.0 | 151 | 12.1 | 6.1 | 1010 | 101 | 3.0 |
| VI | | | | | | | | | | | |
| VII | 2650 | 300 | 190 | 820 | 0.9 | 37 | 4.5 | — | 75 | 37 | 0.4 |
| VIII | 380 | 30 | 10 | 80 | 3.5 | 30 | 7.8 | — | 290 | 130 | 0.6 |
| IX | 38020 | 4400 | 11430 | 2200 | 17.5 | 1320 | 65.9 | 65.9 | 8790 | 110 | 27.5 |
| X | | | | | | | | | | | |
| XI | 4353 | 495 | 1090 | 495 | 4.0 | 148 | 11.9 | 5.9 | 989 | 99 | 3.0 |
| XII | | | | | | | | | | | |
| XIII | 1300 | 170 | 110 | 110 | 0.6 | — | 1.6 | 110 | 30 | 0.5 | |
| XIV | 140 | 20 | 20 | 20 | 3.6 | 20 | 6.0 | — | 320 | 160 | 1.4 |
| XV | 28850 | 3210 | 7830 | 3350 | 14.9 | 1040 | 62.6 | 44.7 | 4470 | 80 | 15.7 |

| Balance component | No. | Quantity kg | Analysis, % by weight S | O | $SiO_2$ | CaO | MgO | $Al_2O_3$ |
|---|---|---|---|---|---|---|---|---|
| Feed | I | | | | | | | |
| Concentrate | II | 1000.00 | 34.80 | — | 3.76 | 1.10 | 0.20 | 0.14 |
| Sand | III | 155.26 | — | 0.30 | 91.74 | 0.46 | 0.22 | 4.70 |
| Product (I): oxidation | IV | | | | | | | |
| Shaft product | V | 990.66 | 6.62 | 12.13 | 18.17 | 1.18 | 0.24 | 0.88 |

Table 1.-continued

| Vaporizing smelting and reduction of complex concentrate | | | | | | | | |
|---|---|---|---|---|---|---|---|---|
| Product (II): oxidation | VI | | | | | | | |
| Matte | VII | 267.50 | 20.40 | 0.50 | — | — | — | — |
| Slag | VIII | 613.00 | 0.33 | 15.38 | 28.55 | 1.68 | 0.29 | 1.42 |
| Flying dust | IX | 91.00 | — | 17.26 | 5.56 | 1.54 | 0.59 | 0.48 |
| Product (II): reduction | X | | | | | | | |
| Shaft product | XI | 1010.70 | 12.28 | 8.22 | 17.81 | 1.16 | 0.23 | 0.86 |
| Product (IV): reduction | XII | | | | | | | |
| Matte | XIII | 354.05 | 21.46 | 1.73 | — | — | — | — |
| Slag | XIV | 501.50 | 13.23 | 0.80 | 34.89 | 2.06 | 0.36 | 1.73 |
| Flying dust | XV | 134.13 | 25.10 | 0.15 | 3.77 | 1.04 | 0.40 | — |

Table 2.

| Vaporizing smelting and reduction of complex concentrate Thermal balance | | | |
|---|---|---|---|
| Balance component | Rate t/Nm³ | Temperature °C. | Heat amount Mcal/h |
| Oxidation process | | | |
| In | | | |
| Concentrate | 20.000 | 25 | 19591 |
| Sand | 3.105 | 25 | −14 |
| Air | 26997 | 325 | 3053 |
| In total | | | |
| Out | | | |
| Shaft product | 19.813 | 1500 | 7373 |
| Gas phase | 25320 | 1500 | 14257 |
| Thermal losses | | | 1000 |
| Out total | | | 22630 |
| Reduction process (A) | | | |
| In | | | |
| Shaft products | — | 1500 | 21630 |
| Petroleum | 0.855 | 25 | 8635 |
| In total | | | 30265 |
| Out | | | |
| Shaft product | 18.821 | 1350 | 9876 |
| Gas phase | 27498 | 1350 | 19487 |
| Thermal losses | | | 902 |
| Out total | | | 30265 |
| Reduction process (B) | | | |
| In | | | |
| Shaft products | — | 1500 | 21630 |
| Carbon dust | 0.861 | 25 | 6683 |
| In total | | | 28313 |
| Out | | | |
| Shaft product | 18.821 | 1350 | 9876 |
| Gas phase | 26596 | 1350 | 17107 |
| Thermal losses | — | — | 1330 |
| Out total | | | 28313 |
| Lower furnace process | | | |
| In | | | |
| Shaft products | — | 1350 | 26983 |
| Oil: Por 230 | 1.080 | 25 | 10472 |
| Air | 10869 | 25 | — |
| In total | | | 37455 |
| Out | | | |
| Matte | 7.081 | 1200 | 5997 |
| Slag | 10.030 | 1250 | 3504 |
| Flying dust | 2.683 | 1300 | 3126 |
| Gas phase | 38359 | 1300 | 23328 |
| Thermal losses | | | 1500 |
| Out total | | | 37455 |

What is claimed is:

1. A process for the suspension smelting of a raw material selected from sulfidic mixed ores and concentrates for separating impurity minerals or metals present in the raw material, comprising finely dividing the raw material and feeding the finely divided raw material along with an oxygen containing gas into a reaction zone of a furnace to form a suspension therein, directing said suspension downwards in the reaction zone, separating the impurity minerals or metals from the rest of the raw material in suspension as vapors by oxidizing the raw material in the reaction zone during a first, oxidation, stage of downward passage of the suspension through the reaction zone at a temperature of 1400°-1600° C., at a partial pressure of sulfur dioxide of 0.08 to 0.20 atmospheres and a partial pressure of oxygen of $10^{-3}$ to $10^{-2}$ atmospheres in said oxidation stage of downward passage of the suspension through the reaction zone; and bringing solid or molten impurity minerals formed in said oxidation of vaporized impurities into the gas phase by subjecting such solid or molten impurity minerals to a reducing or sulfidizing treatment or both at a temperature of 1300° C. to 1400° C. at a partial pressure of sulfur dioxide of 0.08 to 0.20 atmospheres and a partial pressure of sulfur of $10^{-4}$ to $2.10^{-2}$ atmospheres during a second stage of downward passage of the suspension through the reaction zone, the retention time of the suspension in said second stage being about 1 to 2 seconds for preventing such solid or molten impurity minerals from impinging against a molten phase in the furnace below said reaction zone by effecting said vaporization before such impingement can occur and then leading off from the furnace a gas phase bearing the vaporized impurities.

2. The process of claim 1 in which reduction treatment is performed by means of carbon dust.

3. The process of claim 1 in which slagging silicic acid is introduced after the reduction treatment.

4. The process of claim 1, in which the raw material, in addition to copper, iron, and sulfur, contains as impurities no more than 15% by weight of zinc, cadmium, and mercury.

5. The process of claim 1, in which the raw material, in addition to copper, iron and sulfur, contains as impurities less than 1% by weight of Ga, In, and Tl.

6. The process of claim 1, in which the raw material, in addition to copper, iron and sulfur, contains as impurities no more than 20% by weight of Ge, Sn, and Pb.

7. The process of claim 1, in which the raw material, in addition to copper, iron, and sulfur contains as impurities no more than 5% by weight of As, Sb, and Bi.

* * * * *

UNITED STATES PATENT AND TRADEMARK OFFICE

CERTIFICATE OF CORRECTION

PATENT NO. : 4,169,725

DATED : October 2, 1979

INVENTOR(S) : Simo A. I. Makipirtti

It is certified that error appears in the above-identified patent and that said Letters Patent are hereby corrected as shown below:

Col. 7, line 3 - "lower-surface" should be --lower-furnace--.

Col. 7, line 38 - "the direct" should be --to direct--.

Table A, last line, last column - "2.8" should be --2.68--.

Table 1., last line, Flying dust:

XV "8.54 0.05 0.08 37.29 5.67 12.70 - " should be --134.13 8.54 0.05 0.08 37.29 5.67 12.70 - --.

Table 1. (cont.) Analyses, ppm, Line XIII, beginning with col. Hg "110 30 0.5" should be -- - 110 30 0.5--.

Table 2., under col. Heat amount, Oxidation process In total omitted, should be --22630--.

Signed and Sealed this

*Second* Day of *December 1980*

[SEAL]

*Attest:*

SIDNEY A. DIAMOND

*Attesting Officer*

*Commissioner of Patents and Trademarks*